US005335831A

United States Patent [19]

Foster

[11] Patent Number: 5,335,831

[45] Date of Patent: Aug. 9, 1994

[54] INSERTABLE TONER HOPPER SEALING STRIP

[75] Inventor: Mark D. Foster, Lexington, Ky.

[73] Assignee: Lexmark International, Inc., Greenwich, Conn.

[21] Appl. No.: 54,178

[22] Filed: Apr. 30, 1993

[51] Int. Cl.[5] ..... G03G 15/06; G03G 21/00

[52] U.S. Cl. ..... 222/325; 222/DIG. 1; 355/260; 141/364

[58] Field of Search ..... 222/325, 541, DIG. 1; 141/364, 18, 84, 98; 355/260; 220/345

[56] References Cited

U.S. PATENT DOCUMENTS

| | | | |
|---|---|---|---|
| 4,862,210 | 8/1989 | Woolley | 355/260 X |
| 4,930,684 | 6/1990 | Patterson | 222/325 |
| 5,080,745 | 1/1992 | Paull | 222/DIG. 1 X |
| 5,184,182 | 2/1993 | Michlin | 222/DIG. 1 X |
| 5,258,814 | 11/1993 | Davies | 222/DIG. 1 X |

OTHER PUBLICATIONS

*IBM Technical Disclosure Bulletin* article entitled "Lid Assembly", by D. J. Lasher, J. P. Wang and F. Y. Wills, vol. 13, No. 11, Apr. 1971, p. 3218.

*Primary Examiner*—Andres Kashnikow
*Assistant Examiner*—Anthoula Pomrening
*Attorney, Agent, or Firm*—John A. Brady

[57] ABSTRACT

A replacement toner cartridge sealing strip having a smooth support layer (3), a resilient layer (7) attached to the support layer and a smooth, compliant outer layer (9). A finger hole (5) provides a handle. The strip can be inserted by external force into the existing channel of an emptied cartridge to be refilled. The smooth compliant surface does not collect toner as the strip is removed.

15 Claims, 2 Drawing Sheets

INSERTABLE TONER HOPPER SEALING STRIP

TECHNICAL FIELD

This invention relates to the refilling (sometimes termed remanufacture) of electrophotographic toner cartridges. Toner is taken from the cartridge in ordinary course to develop images and therefore the cartridge becomes empty of toner. Some cartridges are suitable for reuse if the toner is replaced (usually with some other reconditioning steps), and it is the refilling with toner of such cartridges to which this invention is directed. To prevent leaking of the toner during shipment of cartridges of interest with respect to this invention, the toner is held in a hopper chamber with a removable seal. At the time of use the seal is removed, and the toner can then drop by gravity into a part of the cartridge having a toner delivery system used for image development. This invention relates to a seal to be inserted before such refilling, in order to seal the toner hopper for shipment.

BACKGROUND OF THE INVENTION

If the toner hopper is separated from the adjoining chamber of the toner cartridge, then a seal may be readily applied using adhesive, heat fusion or other techniques not readily implemented when the two chambers are attached. This invention is specifically directed to developing a insertable seal for the Canon SX Toner cartridge. The original seal in that cartridge is a thin sheet of polyethylene folded back on itself in the long dimension to form a double lamination, with the lamination facing the toner hopper attached to the opening of the hopper. The seal extends out of the cartridge with a plastic tab attached to it to form a handle. At tile time of use, the handle is pulled. The attachment is broken by the pulling force, and the seal is removed. That seal is flimsy and can not be reinserted into the cartridge.

The toner hopper has an access opening from which a plug can be removed, through which toner can be replaced in the hopper. A seal must be applied to the bottom opening of the toner hopper so that the refilled cartridge can be transported. A seal which can be simply and directly inserted in the channel of the hopper in which the original seal was located avoids the costs and burdens of breaking the attachment of the toner hopper to the adjoining chamber. It is also desirable to avoid the costs and burdens of employing a tool which enters the cartridge through the channel to carry the seal to its place or to apply adhesive or heat or the like.

This invention employs a strip having a support lamination and a resilient lamination. Such reinsertable seals are known, as shown in *IBM Technical Disclosure Bulletin* article entitled "Lid Assembly", by D. J. Lasher, J. P. Wang and F. Y. Wills, Vol. 13, No. 11, Apr. 1971, p. 3218, which describes subject matter widely sold commercially beginning in the early 1970's, and U.S. Pat. No. 4,930,684, which advocates facing the hopper with the support layer, the opposite of this invention. This invention attaches a compliant outer layer to the resilient lamination, which is significant both for improved insertion and extraction for minimizing toner carried out by the strip when it is removed.

DISCLOSURE OF THE INVENTION

This invention provides a sealing strip which is insertable by longitudinal pushing force into an existing channel between a toner hopper and a chamber adjoining the toner hopper. The seal has a smooth, heavy substrate layer of plastic to provide support and stiffness. In a lamination on top of that substrate is a plastic foam which has inherent resilience. On top of that foam and bonded to it, is a thin layer of smooth plastic. When inserted the foam side along with thin plastic layer faces the toner hopper to conform to the edges of the opening in the toner hopper, which improves the seal. The strip as a whole is sufficiently stiff to be pushed longitudinally into a channel of the cartridge to which the seal is slightly smaller in width. The seal fills the vertical opening of the channel by the foam portion being slightly depressed because the height dimensions of the channel are smaller than the thickness of the seal. The smooth top and bottom plastic surfaces facilitate insertion and extraction by reducing friction, and the smooth plastic surface facing the toner tends to move away from the toner without collecting it. The strip has an extended handle portion for grasping during removal and a tapered end portion to direct seating at insertion.

This seal strip is very cost effective since it can be inserted with simple, longitudinal force, which can be automated using pinch rollers to direct the strip. The seal avoids having to separate the toner hopper from the adjoining chamber and then rebonding them, and it avoids the use of a tool which enters the cartridge being refilled.

BRIEF DESCRIPTION OF THE DRAWING

The details of this invention will be described in connection with the accompanying drawing in which.

BEST MODE FOR CARRYING OUT THE INVENTION

Figure 1:
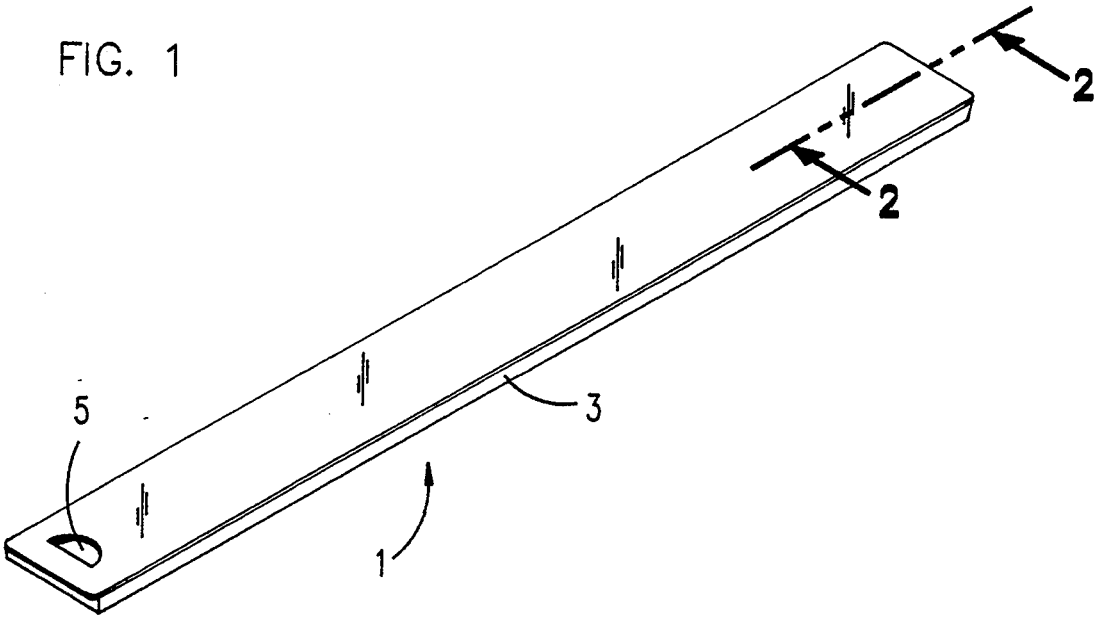
FIG. 1 is a perspective view of the sealing strip.

As shown in FIG. 1 the preferred sealing strip 1 in accordance with this invention has a bottom support lamination 3 of polyethylene terephthalate of thickness of 0.35 mm (this substrate has elongation of 200%, tensile strength of 17/18 KG/square mm, both machine direction; color is natural). This is a smooth, sturdy material which bends moderately under gravity, but is stiff in its longitudinal direction. The strip is 310 mm in length and 44.5 mm in width. The strip has a cut out portion 5 near one end of its longitudinal length providing a finger hole for use as a handle in pulling out the strip.

On top of support 1 is a lamination 7 (FIG. 2) of polyurethane ether foam 1.25 mm in thickness (this foam is density E-150, which is 1.5 lbs./cubic foot or 23–26.2 KG/mm cubed; color is charcoal). This is a cohesive layer having elastic characteristics in normal handling as it is rebounds after being crushed. It happens to be charcoal in color.

On top of lamination 7 is a lamination 9 of polyethylene terephthalate of thickness of 0.05 mm (this lamination has elongation of 150%, tensile strength of 21/25 KG/square mm, both machine direction; color is neutral). This is a smooth material which readily flexes.

Foam lamination 7 is attached to lamination 3 and lamination 9 by adhesive which initially covers the surface of the sides of lamination 3 and 9 which contact lamination 7. To prevent loss of resilience of foam lamination 7, it has been found that the adhesive must not go into the foam of lamination 7. Adhesives which are liquid as applied and are not highly viscous are clearly unsuitable. Adhesives which are solid as applied are potentially suitable and their tendency to enter the foam can be readily determined by simple observation, as well as by theoretical considerations as to surface energies and the like. A polyethylene based thermally activated adhesive functions well in not deactivating the resilience of the foam. (Although the exact details of this adhesive are not known, as they are proprietary to a manufacturing vendor, such adhesives are commercially available and may be identified as required.)

Figure 2:
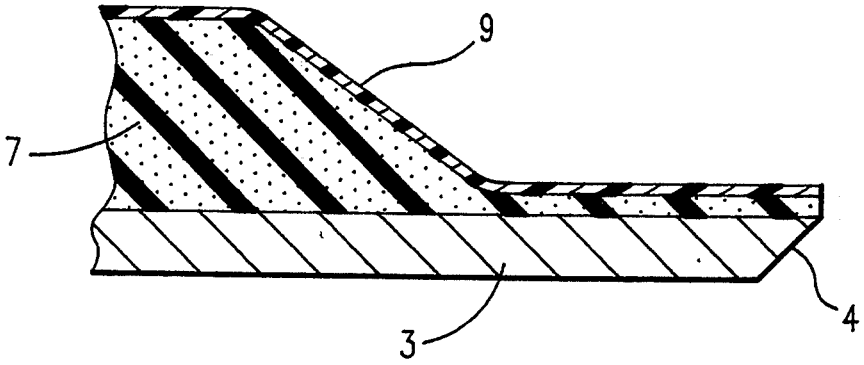
FIG. 2 is a cross sectional view of the sealing strip from the plane 2—2 shown in FIG. 1.

As shown in cross section in FIG. 2, the longitudinal end of the strip 1 is crimped down at a point beginning 2 mm from the end and decreasing linearly for 1 mm and then being approximately a uniform thickness of less than the 0.35 mm thickness of the lamination 1 to the end of the strip. The end 4 of lamination 3 is also chamfered at about 45 degrees. The crimping is performed with heat and pressure on a tool having the outline to be achieved. The chamfering is performed with one pass of a grinding wheel.

Figure 3:
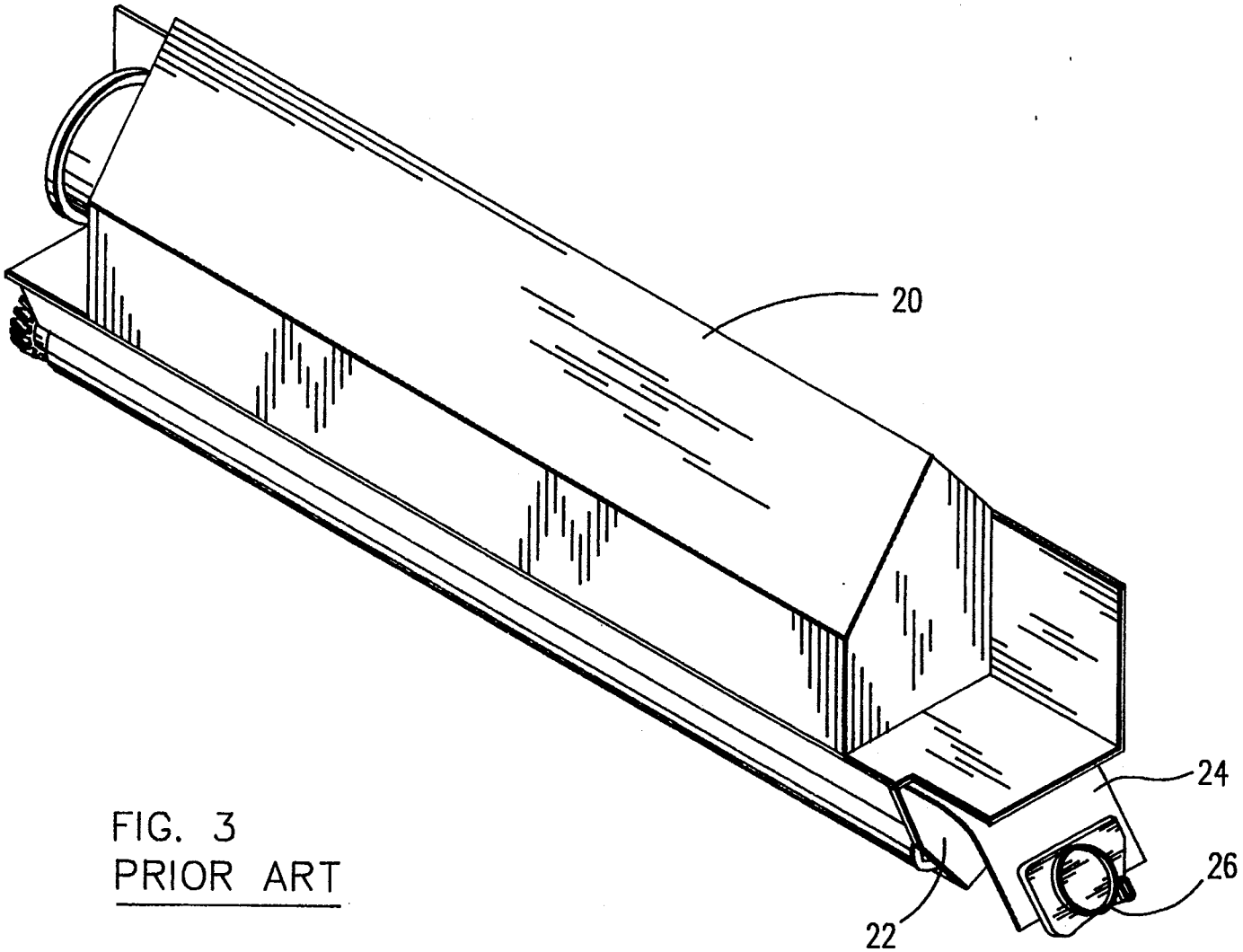
FIG. 3 PRIOR ART
FIG. 3 shows the commercial cartridge for which the sealing strip is intended as a insertable seal with a seal installed.

FIG. 3 is illustrative of the existing toner hopper 20 and attached bottom chamber 22 with a sealing strip 24 inserted. The strip 24 shown is the strip of the toner hopper 20 and chamber 22 as sold by an original manufacturer, as can be told in FIG. 3 by the heavier handle 26 attached to strip 24. The commercially sold cartridge has a second section which is readily separated from the combined hopper 20 and bottom chamber 22, which is not shown as it is not involved with this invention.

Figure 4:
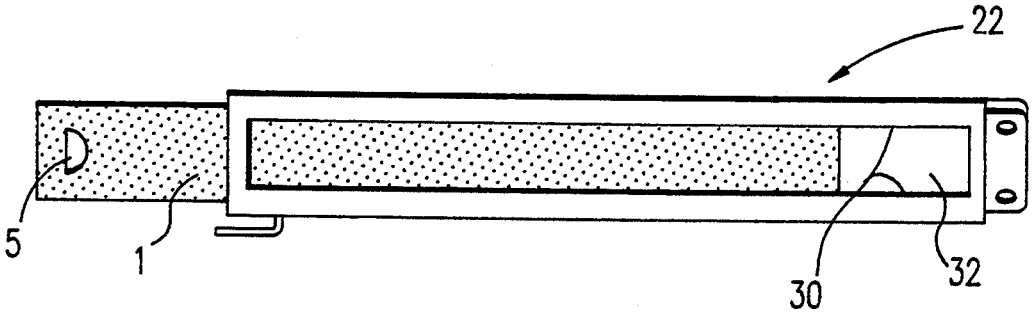
FIG. 4 shows a plan view of the bottom chamber with the sealing strip of this invention partially installed, the hopper not being shown for purposes of illustration.

FIG. 4. shows the strip of this invention partially inserted in the channel 30 in which the original strip 24 fit prior to the first use. (FIG. 4 shows the bottom 22, as separated from the hopper 20 so as to illustrate this invention, but a feature of this invention is that in practice it avoids the need to separate hopper 20 and chamber 22, which are not readily separated as they are connected by ultrasonic welding. Strip 1 is stippled in FIG. 4 to indicate that the foam 7 of strip 1 faces upward.) Bottom chamber 22 has a lower opening 32, which is rectangular, which communicates with the hopper 20 (FIG. 3), and which has around it channel 30 which held the original strip 24. The replacement strip 1 of this invention is shown partially inserted in channel 30. It is slightly less in width than the width of channel 30, but thicker in height than the height of channel 30. (Actual dimensions vary with tolerances.) Channel 30 compresses the foam lamination 7 of strip 1, which provides a tight seal. Because of the stiffness of strip 1 as a whole, it may be inserted by lateral pushing directed along the length of channel 30. The crimped and chamfered end of strip 1 constitutes a guide end which is much smaller than the height of channel 30 and therefore assures entry of strip 1 into the far end of channel 30.

The pushing in of strip 1 may be automated by equipment using pinch rollers across the width of strip 1. These strongly deform foam lamination 7, emphasizing the need for the foam not to lose resilience by being contaminated with adhesive as discussed in the foregoing.

The directly reinsertable strip 1 of this invention is highly cost effective as it avoids costly insertion tools and associated procedures and avoids the need to break apart the hopper 20 and chamber 22, which are not constructed to be readily separated. The smooth outer surface of the compliant layer 9, as well as the smooth outer surface of the support layer 3 facilitate insertion, and the smooth outer surface of layer 9 carries out very little toner, which contrasts greatly with strips having rough or porous materials facing the toner hopper. Having the foam layer 7 with thin compliant layer 9 facing the hopper 20 acts to better secure toner than if a less compliant member faced hopper 20. With full insertion of strip 1 in channel 30, an very effective seal during shipment and handling of toner in hopper 20 is achieved.

Although this preferred embodiment is described as a replacement in a specific commercially available cartridge, this invention is clearly useful for other toner cartridges having an opening to an internal channel around a hopper opening. Modification within the spirit and scope of this invention can be expected and would be within the spirit and scope of this invention.

What is claimed is:

1. An insertable sealing strip for a toner cartridge having a channel around an opening in the toner hopper of such toner cartridge comprising a support lamination smooth on the side constituting the outside of said strip, said support lamination being a first thickness, having a longitudinal dimension, and being stiff in the direction of said longitudinal dimension, a resilient foam lamination attached to said support lamination, and a compliant lamination smooth on the side away from said resilient lamination attached to said resilient lamination on the side opposite said support lamination, said compliant lamination being a second thickness, the ratio of said first thickness to said second thickness being in the order of magnitude of 7 to 1, said strip being rigid against pushing force in the direction of said longitudinal dimension and having a handle portion on one end for pulling said strip from said cartridge when said cartridge is prepared for use in imaging.

2. The sealing strip as in claim 1 in which said handle portion is an opening in said strip.

3. The sealing strip as in claim 1 in which said foam lamination comprises a polyurethane ether foam of about 1.25 mm thickness.

4. The sealing strip as in claim 3 in which said foam is permanently deformed to reduced thickness at the end of said strip opposite said handle portion and said support lamination is chamfered at said end opposite said handle portion.

5. The sealing strip as in claim 4 in which said handle portion is an opening in said strip.

6. A toner cartridge having a toner hopper and a connecting chamber to receive toner from said hopper during use for imaging, an opening in said hopper communicating with said chamber, a channel around said opening, a sealing strip in said channel, said strip having a support lamination facing said chamber, said support lamination being a first thickness, having a longitudinal dimension, and being stiff in the direction of said longitudinal dimension, said strip having a resilient lamination attached to said support lamination on the side facing said hopper, and said strip having a compliant lamination attached to said resilient lamination and smooth on the side facing said hopper, said compliant lamination being a second thickness, the ratio of said first thickness to said second thickness being in the order of magnitude of 7 to 1, said strip having a thickness such that said channel compresses said resilient lamination in the direction of the thickness of said strip to form a tight seal to hold toner in said hopper.

7. The toner cartridge as in claim 6 in which said strip has a handle portion on one end for pulling said strip from said cartridge.

8. The toner cartridge as in claim 6 in which said resilient lamination comprises a polyurethane ether foam of about 1.25 mm thickness.

9. The toner cartridge as in claim 6 in which said resilient lamination is permanently deformed to reduced thickness at one end of said strip and said support lamination is chamfered at said one end.

10. The toner cartridge as in claim 7 in which said handle portion is an opening in said strip.

11. An insertable sealing strip for a toner cartridge having a channel around an opening in the toner hopper of such toner cartridge comprising a support lamination smooth on the side constituting the outside of said strip, a resilient foam lamination attached to said support lamination, and a compliant lamination smooth on the side away from said resilient lamination attached to said resilient lamination on the side opposite said support lamination, said strip being rigid against longitudinal pushing force and having a handle portion on one end for pulling said strip from said cartridge when said cartridge is prepared for use in imaging, said foam lamination being permanently deformed to reduced thickness at the end of said strip opposite said handle portion and said support lamination being chamfered at said end opposite said handle portion.

12. The sealing strip as in claim 11 in which said handle portion is an opening in said strip.

13. A toner cartridge having a toner hopper and a connecting chamber to receive toner from said hopper during use for imaging, an opening in said hopper communicating with said chamber, a channel around said opening, a sealing strip in said channel, said strip having a support lamination facing said chamber, a resilient lamination attached to said support lamination on the side facing said hopper, and a compliant lamination attached to said resilient lamination and smooth on the side facing said hopper, said strip having a thickness such that said channel compresses said resilient lamination in the direction of the thickness of said strip to form a tight seal to hold toner in said hopper, said resilient lamination being permanently deformed to reduced thickness at one end of said strip and said support lamination being chamfered at said one end of said strip.

14. The toner cartridge as in claim 13 in which said strip has a handle portion on the end opposite said one end for pulling said strip from said cartridge.

15. The toner cartridge as in claim 14 in which said handle portion is an opening in said strip.

* * * * *